United States Patent [19]

Breuer et al.

[11] Patent Number: 4,819,990

[45] Date of Patent: Apr. 11, 1989

[54] FLOOR CUTTERS FOR MINERAL WINNING PLOUGHS

[75] Inventors: Oswald Breuer, Dortmund; Christoph Rassmann, Lunen; Egon Pfefferle, Hamm; Gunther-Dietmar Schoop, Ottmarsbocholt, all of Fed. Rep. of Germany

[73] Assignee: Gewerkschaft Eisenhutte Westfallia GmbH, Fed. Rep. of Germany

[21] Appl. No.: 115,886

[22] Filed: Nov. 2, 1987

[30] Foreign Application Priority Data

Nov. 8, 1986 [DE] Fed. Rep. of Germany ..... 3638135

[51] Int. Cl.[4] ..... E21C 35/18

[52] U.S. Cl. ..... 299/80; 299/91; 228/119; 228/191

[58] Field of Search ..... 299/79, 80, 91–93, 299/34; 37/142 R; 228/119, 191

[56] References Cited

U.S. PATENT DOCUMENTS 2,317,932 4/1943 Moore ..... 37/142 R
2,419,677 4/1947 Daniels et al. ..... 37/142 R
2,841,896 7/1958 Meshorer ..... 37/142 R
4,076,318 2/1978 Havschopp et al. ..... 37/142 R

FOREIGN PATENT DOCUMENTS 1233809 2/1967 Fed. Rep. of Germany .
1278375 9/1968 Fed. Rep. of Germany .
3431495 3/1986 Fed. Rep. of Germany .
1552989 10/1979 United Kingdom .

*Primary Examiner*—Jerome W. Massie, IV
*Assistant Examiner*—David J. Bagnell
*Attorney, Agent, or Firm*—Samuels, Gauthier, Stevens & Kehoe

[57] ABSTRACT

A floor cutter for a plough has a component provided with cutting edges fixed by welding to a main body locating in a holder. The components are connected together with step-like surfaces chamfered at the external faces of the components to faciliate the welding. Superimposed support surfaces extend more or less normally to other surfaces and permit adjustment of the position of the components during welding to vary the set cutting depth.

4 Claims, 4 Drawing Sheets

FLOOR CUTTERS FOR MINERAL WINNING PLOUGHS

BACKGROUND TO THE INVENTION

1. Technical Field of the Invention

The present invention relates to cutters for mineral winning machines and particularly for coal ploughs.

2. Description of Prior Art

As is known, ploughs for winning coal or other mineral in underground mine workings are equipped with replaceable cutter bits as well as special floor cutters which have two cutting edges set at an angle to one another. The floor cutters then cut the floor and the mineral face as the plough is moved along the face. The floor cutters are subjected to heavy stress and the cutters themselves are usually mounted on adjustable carriers, such as rocker levers or the like, to enable the cutting level of the plough to be adjusted. Depending on the seam conditions floor cutters need to be able to work with different cutting depths relative to the mineral face. Usually this means that a range of floor cutters defining different cutting dimensions needs to be stocked and the expense of manufacturing and storing sets of cutters is considerable. It is also known to replace worn cutters by separating a hardened tip from the main cutter body with a flame torch and then welding a new tip to the body. As an alternative it has been proposed to secure the tip provided with the cutting edge(s) to the cutter body with the aid of screws or the like. Examples of such construction are described in GB No. 1552989, DOS No. 3431495, DPS No. 1233809 and U.S. Pat. No. 4,076,318. In the case of floor cutters, it is known to fasten the cutter tip to the body with a plug-in connection and to use a pin or peg to secure the tip in place (see DPS No. 1278375). In practice, none of the above-mentioned constructions have become widely adopted in practice because they are expensive to produce and the connection between the cutter tip component and the main body component is not reliable, especially when the floor cutter is subjected to impact forces.

A general object of the present invention is to provide an improved floor cutter in which the design is simplified and the production cost is minimized. A further object is to provide a two-part cutter where the cutting edge part or tip is reliably connected to the main body in a manner permitting ready replacement of the tip. Another object of the invention is to provide a floor cutter in which a standard design can provide floor cutters with a variety of cutting depths thereby obviating the need to stock a range of cutters.

SUMMARY OF THE INVENTION

As is known, a floor cutter according to the invention has two components namely a first component with a main body and a shank for fitting into a holder and a second component provided with cutting edges. In accordance with the invention these components are provided with shaped inter-engaging faces of step-like configuration and the components are connected together by welding around the stepped faces. These faces include supportive positioning faces orientated predominantly perpendicular to the other face or faces and extending transversally of the cutter and towards the mineral face when in use. These support or positioning faces are superimposed and permit relative adjustment of the components prior to welding. This important aspect enables the cutting depth of the cutter to be varied without altering the height of the cutter. In other words, control of the cutting edge engaging the face is enabled while the cutter edge engaging the floor remains at the same position relative to the floor. The stepped configuration also provides enhanced positive connection between the components supplementing the welded joint and the support faces ensure the components are positioned correctly for the welding operation.

In a preferred construction, the characteristic stepped faces comprise first faces orientated in one plane, second faces orientated in another plane substantially perpendicular or near perpendicular to the one plane and third faces orientated in a further plane parallel to said one plane. The second faces, which form the aforementioned support or positioning faces, preferably extend the full width of the first and third faces and transversally of the cutter. Relative sliding of these second faces controls the depth of cut.

To facilitate the welding of the components, the faces are preferably chamfered at their juncture with side faces of the components to accept the welding seam or fillet. Further in accordance with the invention, to remove the components with the cutting edges for replacement, a torch or flame gun is moved over the side faces in a somewhat S-shaped pass conforming with the stepped profile to heat and then release and separate the components.

Preferably, the cutting edges are defined as a hardened region of the cutting edge component. If the stepped faces are remote from the cutting edges no harmful thermal stresses occur in the welding or disconnecting operations.

The invention may be understood more readily, and various other aspects and features of the invention may become apparent, from consideration of the following description.

BRIEF DESCRIPTION OF DRAWINGS

An embodiment of the invention will now be described, by way of example only with reference to the accompanying drawings, wherein.

DESCRIPTION OF PREFERRED EMBODIMENT

Figure 1:
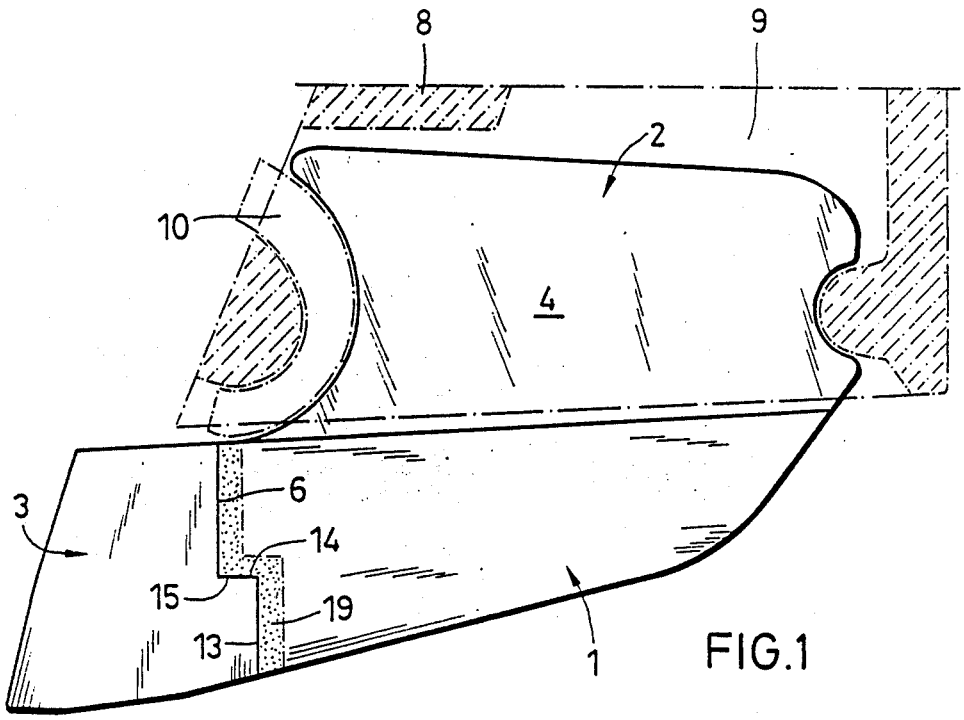
FIG. 1 is a schematic representation of a cutter constructed in accordance with the invention.
Figure 2:
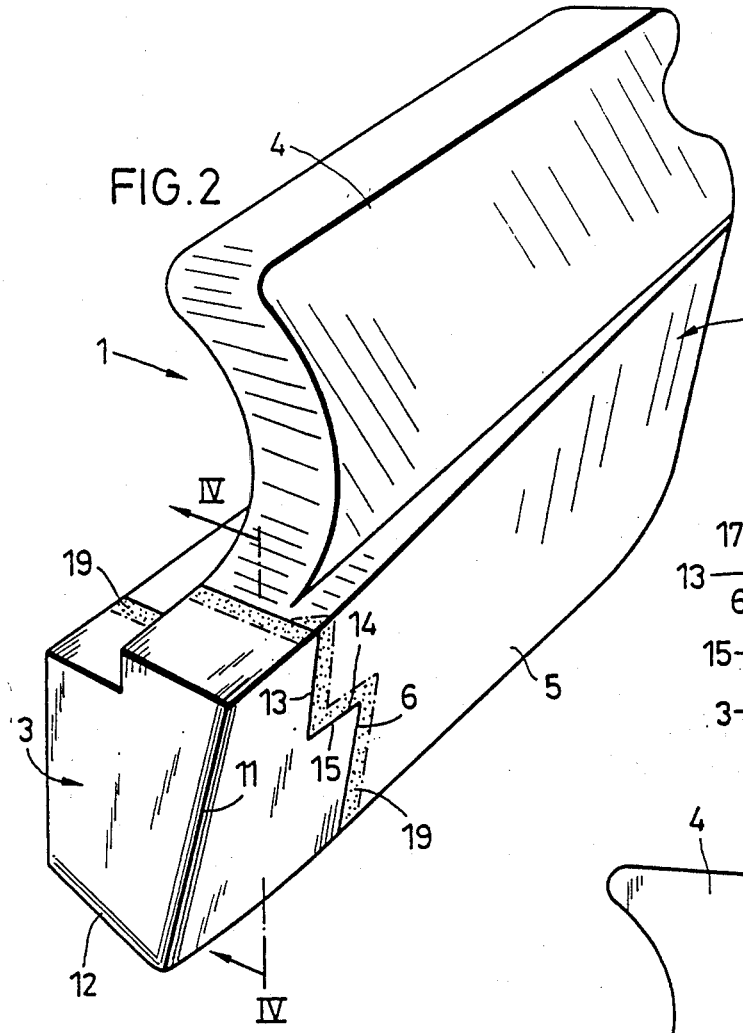
FIG. 2 is a perspective view of the cutter.
Figure 4:
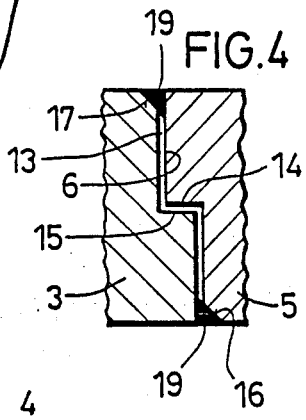
FIG. 4 is a section taken along the line IV—IV of FIG. 2.
Figure 3:
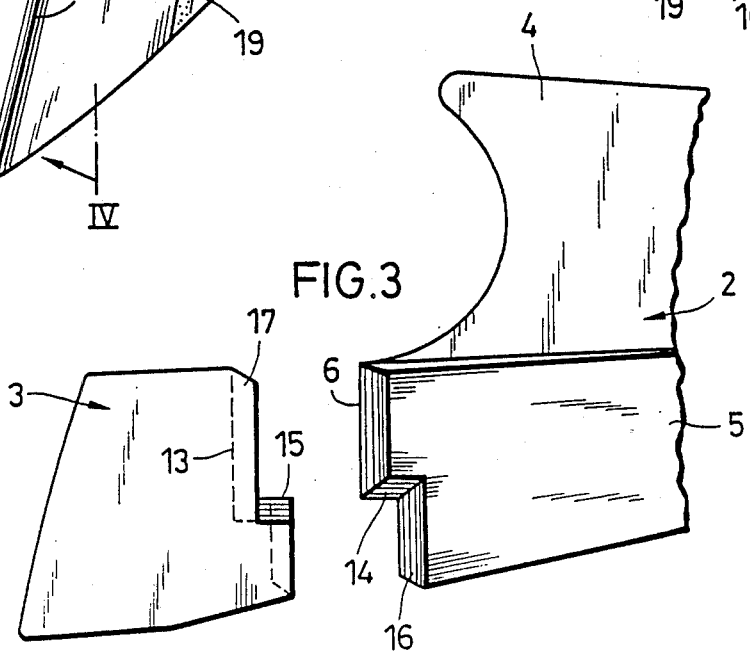
FIG. 3 is a representation of part of the cutter in a disassembled state.
Figure 5:
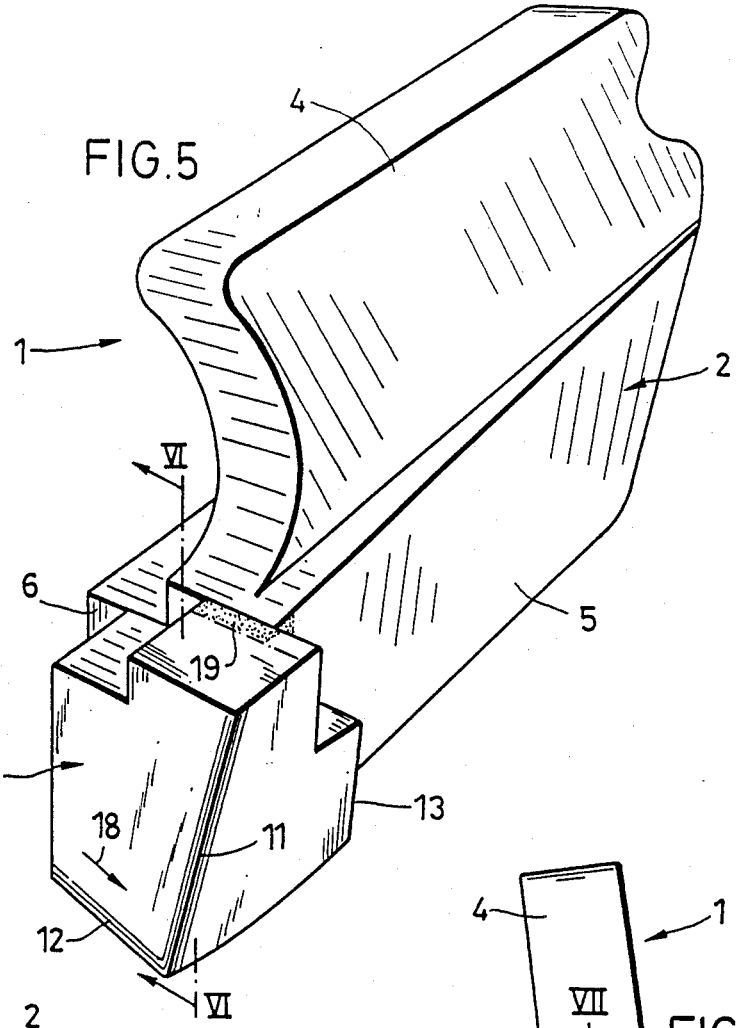
FIG. 5 s a view corresponding to FIG. 2 but with components of the cutter fitted in a different position.
Figure 6:
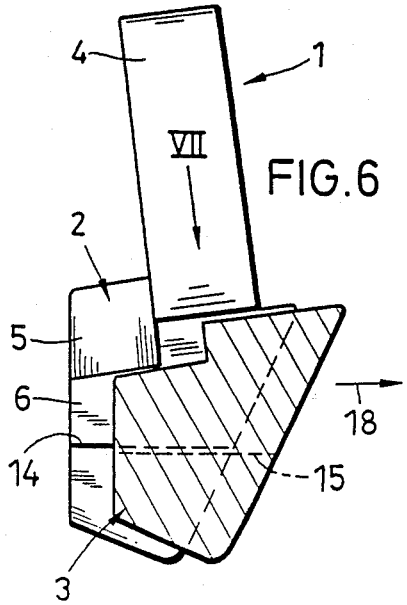
FIG. 6 is a section taken along the line VI—VI of FIG. 5.
Figure 7:
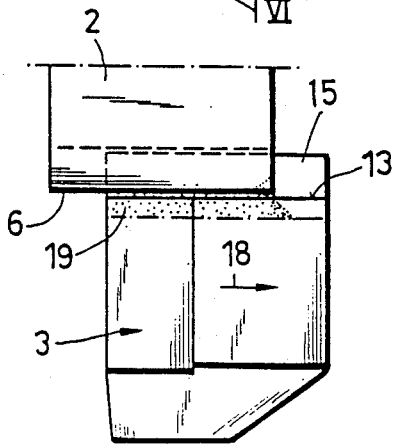
FIG. 7 is a view of the cutter taken in the direction of arrow VII in FIG. 6.

As shown in FIGS. 1 to 7 of the drawings a cutter 1 intended to be used as a floor cutter for a plough has a main body 2 with a shank 4 and a separate cutting edge defining part 3 welded to the body 2. The body 2 is of plate-like form manufactured as a casting or forging. As depicted in FIG. 1, the shank 4 is secured for use to a holder 8 which may be of known type. The holder 8 is conveniently secured to a rocker lever mounted in an adjustable manner on the plough to permit the cutting horizon of the cutter to be adjusted. The shank 4 locates in a pocket 9 of the holder 8 and has the shape shown in FIG. 5. The shank 4 is detachably locked in place with the aid of a locking member, such as an arcuate wedge 10 shown in FIG. 1. The other component part 3 of the cutter 1 is provided with two hardened cutting edges (designated 11, 12 in FIGS. 2 and 5) which serve to cut the floor and the mineral face of a mineral, e.g. coal mine working. The part 3 is welded to the base region 5 of the body 2 and the surfaces 6, 13, 14, 15 of the part 3 and the region 5 of the body 2 which mate together and are welded are offset surfaces of step-like configuration enabling the components 2, 3 to be positioned and oriented with ease prior to welding. The faces 14, 15 extend perpendicularly or at some other angle preferably near normal, to the other faces 6, 13 and at a set angle transverse to the cutter 1, to act primarily as positioning and support faces. The part 3 can thus be bought into position with the faces 14,15 in superimposed supportive contact and the faces 14,15 may slide against one another as the part 3 is moved towards the face as indicated by arrow 18 in FIGS. 5 to 7. This adjustive movement does not result in any variation in the operative height of the cutting edge 12. FIG. 1 shows the part 3 fitted in its normal position with a fillet weld securing the part 3 to the body 2. To facilitate the welding, the faces 6, 13, 14, 15 are chamfered at the junctions with the external faces of the components 3, 2 as indicated by references 16, 17 in FIGS. 3 and 4. The weld seam is indicated by the dotted lines 19 in FIG. 1, 2, 5 and 7. In this normal position the side faces of the part 3 are more or less aligned with the side faces of the base region 5 of the body 2. A specific cutting depth of the cutter 1 in relation to the mineral face is thus created. If the cutting depth is to be varied, for example increased by 10mm, then the part 3 can be shifted towards the face (arrow 18) in relation the body 2 without altering the cutting height in relation to the floor and then welded in place. It is thus quite feasible to use the same component parts to provide cutters with a range of cutting heights. The faces 14, 15 permit an exact location of the cutting edge part 3 in relation to the body 2 and if a worn cutter edge part 3 is to be replaced the weld seam 19 can be removed by the application of heat. In this operation a somewhat S-shaped pass is made with the flame torch or burner along the faces 6, 13, 14, 15 from one side of the cutter 1 to release and separate the faces 6, 13, 14, 15. A new cutting edge part 3 can then be relocated and welded in place.

Figure 8:
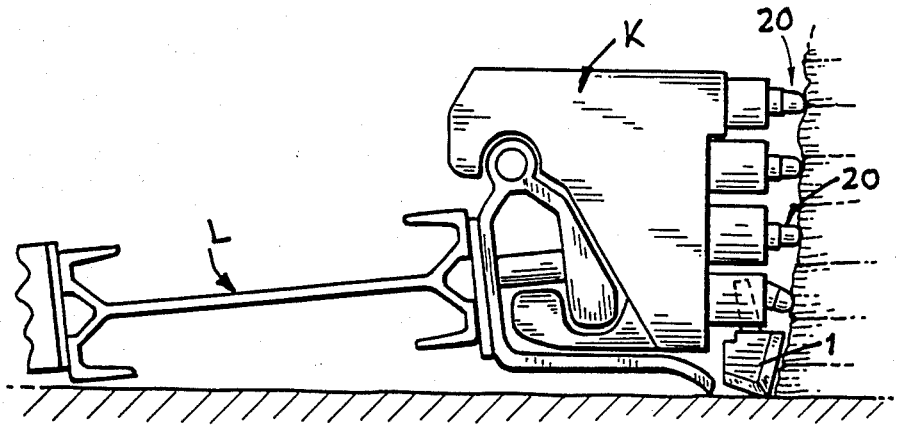
FIG. 8 is a end view of a mineral mining installation employing a plough equipped with floor cutters in accordance with the invention.

FIG. 8 depicts a typical mineral winning installation with a plough K guided for movement along a conveyer L. The plough K is equipped with staggered cutter bits 20 and floor cutters 1, as described, constructed in accordance with the invention.

We claim:

1. A floor cutter for use in mineral winning machines, such as ploughs; said cutter comprising a first component formed with a shank for detachable reception in a holder and a base portion opposite the shank and a second component formed with cutting edges extending in different directions, the second component being fixed by welding to the base portion of the first component with the cutting edges respectively defining a cutting depth relative to a mineral face of a mine working and a cutting height relative to a floor of the working; and complementary step-like surfaces provided on the base portion of the first component and the second component which contact and positively interengage to position the components relatively prior to welding; wherein said surfaces include first surfaces of the base portion and of the second component which lie in a first plane, support surfaces of the base portion and the second component which extend transversally of the components and substantially perpendicular to the first surfaces and further surfaces of the base portion and second component which lie in a further plane substantially parallel to the first plane and wherein the support surfaces are superimposed in supportive contact with each other to permit the second component to adopt any position relative to the first component to provide a plurality of defined different cutting depths while maintaining the same cutting height relative to the floor and the components are welded together around the junctions of the step-like surfaces with other external surfaces of the components once the relative position of the components has been selected to provide the defined cutting depth.

2. A cutter according to claim 1, wherein the support surfaces extend substantially perpendicularly to other surfaces offset by the support surfaces and the support surfaces extend over the entire width of the components.

3. A cutter according to claim 1, where the support surfaces extend at an acute angle relative to the horizontal which increases towards the mineral face.

4. A cutter according to claim 1, wherein end regions of the surfaces are chamfered to receive a welding fillet.

* * * * *